US006431934B2

(12) United States Patent
Cressi

(10) Patent No.: US 6,431,934 B2
(45) Date of Patent: Aug. 13, 2002

(54) UNDERWATER DIVING BUOYANCY COMPENSATOR JACKET WITH QUICK-RELEASE VALVES WHICH CAN BE OPERATED SIMULTANEOUSLY

(75) Inventor: Leopoldo Antonio Cressi, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 0 days.

(21) Appl. No.: 09/730,809

(22) Filed: Dec. 7, 2000

(30) Foreign Application Priority Data

Apr. 28, 2000 (IT) ..... FI200039 U

(51) Int. Cl.[7] ..... B63C 9/105
(52) U.S. Cl. ..... 441/96; 405/186
(58) Field of Search ..... 405/185, 186; 441/88, 96, 99

(56) References Cited

U.S. PATENT DOCUMENTS 4,114,389 A 9/1978 Bohmrich et al.
5,256,094 A * 10/1993 Canna ..... 441/96
5,607,258 A * 3/1997 Eugard ..... 405/186
5,662,433 A * 9/1997 Seligman ..... 405/186
5,980,158 A 11/1999 Griffiths et a.
6,120,213 A * 9/2000 Stinton ..... 405/186
6,217,257 B1 * 4/2001 Garofalo et al. ..... 405/186

FOREIGN PATENT DOCUMENTS

EP 0 921 064 6/1999

* cited by examiner

*Primary Examiner*—S. Joseph Morano
*Assistant Examiner*—Andy Wright
(74) *Attorney, Agent, or Firm*—Browdy and Neimark

(57) ABSTRACT

A buoyancy compensator jacket comprising at least one air chamber (3) associated to a back portion (2) of the jacket and a couple of quick-release valves (6, 7), arranged on an outer face **(2*a*) of said back portion (2), respectively near the upper and lower edges (2*b*, 2*c*) thereof. Respective ropes (8, 9) extend from the valves (6, 7) for the operation thereof. A supplementary operation rope (11) extends from the lower valve (7), the supplementary rope (11) of the lower valve (7) and the rope (8) of said upper valve (6) being mutually connected at least in correspondence to the free ends, whereby the air chamber (3) can be deflated through both valves (6, 7)** by means of a single action.

5 Claims, 1 Drawing Sheet

UNDERWATER DIVING BUOYANCY COMPENSATOR JACKET WITH QUICK-RELEASE VALVES WHICH CAN BE OPERATED SIMULTANEOUSLY

FIELD OF THE INVENTION

The present invention relates to the field of underwater diving equipment, and more properly to a new type of buoyancy compensator jacket.

BACKGROUND OF THE INVENTION

It is known that underwater divers, hereinafter referred to simply as divers, make use of buoyancy compensator jackets, having one or more air chambers. These can be inflated—by oral or thanks to compressed gas inflation means—and deflated in order to provide for buoyancy trim or compensation to the diver.

In greater detail, the aim of said jackets is that of maintaining the buoyancy of the diver to a substantially neutral state as his depth varies. In this way, he is always allowed to move in all directions with the utmost ease. In fact, it has to be considered that as the diver dives deeper, due to the water pressure increase and to the consequent compression of the exposure suit and associated diving equipment as well as of the body cavities, his inherent lifting characteristics decreases, making the ascension movements harder. Such decrease is compensated by progressively inflating the jacket. Conversely, as the diver ascends to the surface his inherent buoyancy increases and air must be gradually released from the jacket in order to maintain the overall buoyancy to a substantially neutral state.

The air chambers, placed in the back portion of the jacket, are pneumatically accessible, for the inflation/deflation operations, via an inflater tube, extending from the jacket and provided with an end valve. Besides, there is at least one further quick-release over pressure valve, directly attached to the back face of the jacket and which can be operated by pulling a rope. The supplementary valves support the operation of the inflater tube valve, namely assuring a quick—and as complete as possible—air release from the chamber.

In the prior art two back valves are usually arranged, respectively, near the upper and lower edges of the jacket. The upper valve is operated via a rope located over the shoulder of the diver, while the lower one has an operating rope extending downwards in the waist area.

The upper valve accomplishes a most favorable air release when the diver dives towards the surface, i.e. with his feet pointing downwards. On the other hand, the lower valve assures a complete deflation of the jacket when it is the head that points downwards, thus preventing air pockets from forming in the waist area in this quite common situation.

However, the above described arrangement has the drawback that the diver must perform different operations depending on his position. Besides, in order to achieve an as quick deflation as possible, sometimes it would be useful to operate the two valves simultaneously. But such an operation is troublesome, mainly due to the fact that the lower valve rope is not easy to reach, and consequently it is, practically, never carried out.

SUMMARY OF THE INVENTION

The object of the present invention is to overcome said drawback, by providing a buoyancy compensator jacket in which the air chamber can be deflated completely in the easiest and quickest way, whichever the position of the diver is.

Such object is achieved with the buoyancy compensator jacket according to the present invention, comprising a couple of quick-release valves, associated to the air chamber provided in the back portion of the jacket, arranged, respectively, near the upper and lower edges of such portion, respective ropes extending from the valves for the operation thereof. A supplementary operation rope extends from the lower valve. Such supplementary rope and the rope of the upper valve are mutually connected at least in correspondence to the free ends, whereby the air chamber can be deflated through both valves by means of a single action.

BRIEF DESCRIPTION OF THE DRAWINGS

The features and advantages of the buoyancy compensator jacket with quick-release valves which can be operated simultaneously according to the present invention will be made clearer with the following description of an embodiment thereof, made purely by way of example and not limitative, with reference to the attached drawings in which.

DETAILED DESCRIPTION OF THE PREFERRED EMBODIMENT

Figure 1:
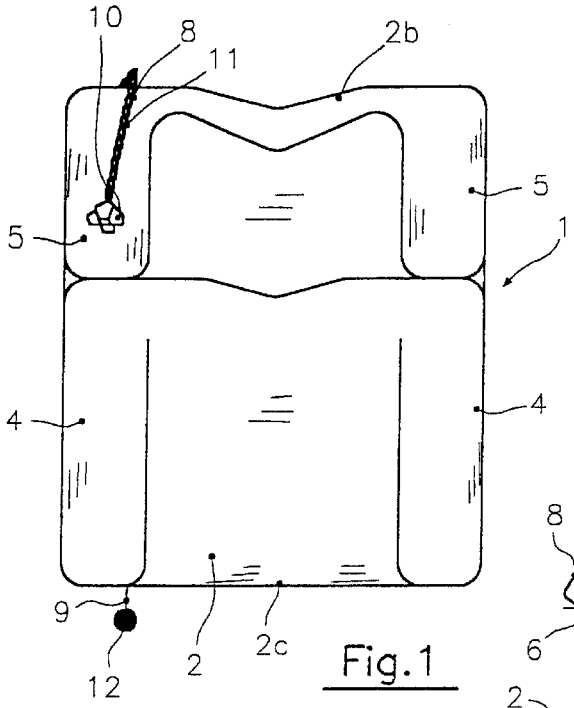
FIG. 1 is a schematic front view of the buoyancy compensator jacket according to the invention.
Figure 3:
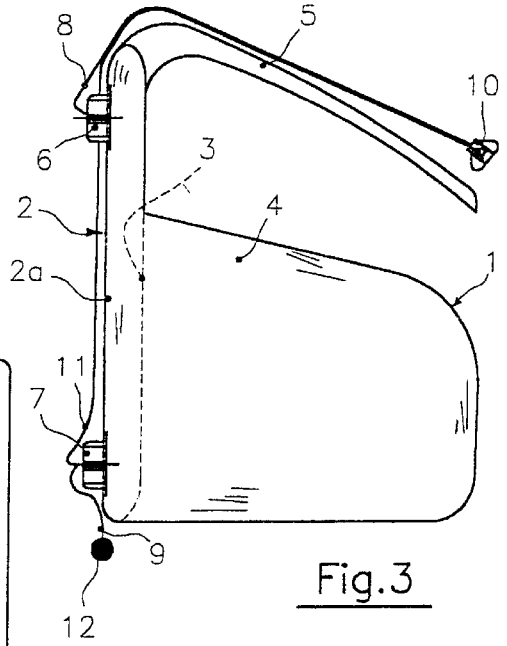
FIG. 3 is a schematic side view of the jacket of the previous figures.
Figure 2:
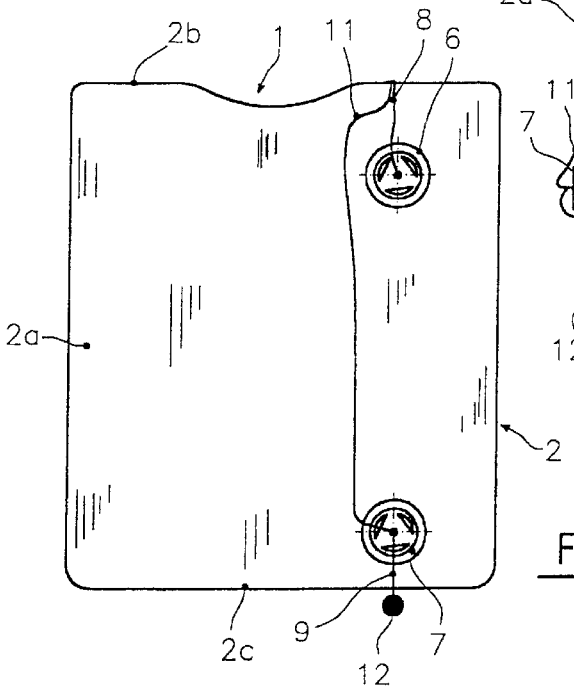
FIG. 2 is a schematic back view of the jacket of FIG. 1.

With reference to the above figures, a buoyancy compensator jacket 1 according to the present invention is depicted schematically, a more detailed illustration being unnecessary in order to fully appreciate the features of the invention itself.

One can distinguish, in jacket 1, a back portion 2, incorporating an air chamber 3 and providing an outer face 2*a* extending between an upper edge 2*b* and a lower one 2*c*. Air chamber 3 is pneumatically accessible via an inflater tube according to the prior art, not shown.

Jacket 1 further comprises, besides two side portions 4, two shoulder portions 5, projecting from upper edge 2*b* of back portion 2 for wrapping over the shoulders of the diver until the respective free ends 5*a* are placed on the chest.

Two over pressure back valves assuring a quick release of air chamber 3 are arranged on the outer face 2*a* of back portion 2. More precisely, an upper valve 6 is placed adjacently to upper edge 2*b*, whereas a lower valve 7 is placed adjacently to lower edge 2*c*. In the depicted embodiment upper and lower valves 6, 7 are mutually aligned according to a direction which is substantially orthogonal to the above cited edges. Valves 6, 7 are, per se, according to the prior art, providing respective operation ropes 8, 9 extending, respectively, over the corresponding shoulder portion 5, and downwards beyond lower edge 2*c* of back portion 2. Ropes 8, 9 have respective grip knobs 10, 12.

According to the invention, lower valve 7 has also a supplementary operation rope 11, extending on outer face 2*a* of back portion 2 and, after meeting upper valve 6, couples with rope 8 of the latter, placing over the corresponding shoulder portion 5. In this way, the two ends of ropes 8 and 11 are close to the free end 5*a* of shoulder portion 5 and mutually connected by grip knob 10.

The provision of the two valves 6, 7 allows a fully efficient deflation whichever the position of the diver is. On the other hand, this does not result in a complication as far as the quickness and easiness of the operation are concerned, thanks to the fact that rope 8 of upper valve 6 and supplementary rope 11 of lower valve 7 are mutually connected and conveniently reachable on the waist of the diver. Consequently, he can operate simultaneously both valves 6, 7 easily and with the same action irrespective of his position. In any case, conventional rope 9 provides for an independent operation of lower valve 7, whenever this may be required.

Even though in the schematic representation of the figures the two ropes 8 and 11 are free on the outside of the jacket, preferably they may be slid ably housed in suitable sheaths, for preventing the ropes from undesirably moving and namely for maintaining knob 10 in a suitable position on the relevant shoulder portion .

It has also to be emphasized that the expressions upper and lower, and other above used analogous ones, refer to the jacket when worn by the diver standing on the ground, that is to say in the position shown in the figures.

Variations and/or modifications can be brought to the underwater diving buoyancy compensator jacket with quick-release valves which can be operated simultaneously according to the present invention without departing from the scope of the invention itself as defined in the appended claims.

What is claimed is:

1. A buoyancy compensator jacket comprising at least one air chamber (3) associated to a back portion (2) of said jacket and a couple of quick-release valves (6, 7) which when opened permit release of air from the air chambers (3), said valves arranged on an outer face **(2*a*) of said back portion (2) respectively near the upper and lower edges (2*b*, 2*c*) thereof, respective ropes (8, 9) extending from said valves (6, 7) for opening thereof, wherein a supplementary operation rope (11) extends from the lower valve (7), said supplementary rope (11) of said lower valve (7) and the rope (8) of said upper valve (6) being mutually connected at least in correspondence to free ends thereof, wherein said air chamber (3) can be deflated through both valves (6, 7) by means of a single action to open the valves by actuating the supplementary operation rope and wherein said air chamber can further be deflated by actuating either the rope (8) corresponding to the valve near the upper edge or the rope (9)** corresponding to the valve near the lower edge.

2. The buoyancy jacket according to claim 1, wherein said supplementary rope (11) of said lower valve (7) extends along said back portion (2) and on a shoulder portion (5) of the jacket, so as to be operated from a waist side of the shoulder portion.

3. The buoyancy jacket according to claim 1, wherein said supplementary rope (11) of said lower valve (7) is slid ably housed within a protective sheath formed on said back portion (2) and on said shoulder portion (5).

4. The buoyancy jacket according to claim 3, wherein the rope (8) of said upper valve (6) is partially housed slid ably within said sheath.

5. The buoyancy jacket according to claim 1, wherein the free ends of the rope (8) of said upper valve (6) and of the supplementary rope (11) of said lower valve (7) are mutually connected by a single grip knob (10).

* * * * *